United States Patent [19]

Wiens et al.

[11] Patent Number: 4,711,260

[45] Date of Patent: Dec. 8, 1987

[54] APPARATUS WHICH IS CONVERTIBLE BETWEEN AN UMBRELLA AND A GOLFING BACKSTOP

[76] Inventors: Terry G. Wiens, 1814 196th Street, Langley, British Columbia, Canada, V3A 4P4; William L. Featherston, P.O. Box 1939, Squamish, British Columbia, Canada, V0N 3G0

[21] Appl. No.: 866,784

[22] Filed: May 23, 1986

[51] Int. Cl.[4] ..... A45B 3/00

[52] U.S. Cl. ..... 135/16; 135/20 R; 273/181 F

[58] Field of Search ..... 135/20 R, 25, 16; 273/181 F

[56] References Cited

U.S. PATENT DOCUMENTS

| | | | |
|---|---|---|---|
| 920,907 | 5/1909 | Bolton | 273/181 F |
| 2,681,070 | 6/1954 | Dippolito | 135/16 |
| 2,788,792 | 4/1957 | Koller | 135/20 R |
| 3,184,235 | 5/1965 | Hilbrich | 273/181 F |
| 3,856,301 | 12/1974 | Davidson | 273/181 F X |
| 4,492,380 | 1/1985 | Saytar | 273/181 F X |

*Primary Examiner*—J. Karl Bell

*Attorney, Agent, or Firm*—Hughes & Cassidy

[57] ABSTRACT

A golfing apparatus which has the combined function of an umbrella and a backstop for a low trajectory golf ball. In the umbrella configuration, the apparatus operates as a conventional umbrella and may be repositioned from a closed to an open position where the canopy portion of the umbrella extends downwardly in a bowed configuration. The canopy may be inverted to another position in which the canopy extends in an upward bowed configuration so that the canopy may be placed on its side to act as a backstop for practicing golf shots. The canopy includes pockets which act as targets and as receptacles for the golf ball when it strikes the target.

11 Claims, 15 Drawing Figures

APPARATUS WHICH IS CONVERTIBLE BETWEEN AN UMBRELLA AND A GOLFING BACKSTOP

TECHNICAL FIELD

The present invention relates to an umbrella which may be converted to a backstop and used as a target for golfing practice.

BACKGRCUND OF THE INVENTION

It is not uncommon for golfers to be required to wait several minutes before teeing off at various times during a golfing game due to the presence of other preceding golfers on the fairways and greens. When the golf course is crowded or the preceding golfers are somewhat slow, this waiting period can be somewhat longer than several minutes. While waiting, many golfers prefer to engage in additional practice prior to playing the next hole. Some of these golfers will simply take one or two practice swings without striking the ball, while others will practice their short shots by actually striking the ball so that it hopefully only travels a short distance. Sometimes however, this results in the golf ball being driven further than anticipated so that the ball interferes with other golfers on the course. There is a need, therefore, for a backstop which can be quickly and easily erected by a golfer, which will prevent the golf ball from traveling further than desired, and which may be conveniently stored and carried by the golfer during the golf game.

Various conventional backstops have been disclosed. For example, in U.S. Pat. Nos. 3,856,301 by Davidson, 3,184,235 by Hilbrich, and 920,907 by Bolton, there are disclosed collapsible backstops which are adapted to be supported in an upstanding manner on a playing surface in order to interrupt the travel of a ball.

Other backstops used to stop a golf ball or the like are disclosed in U.S. Pat. Nos. 3,001,795 by Johnson; 3,758,116 by Pieronik; 2,455,185 by May; and 222,978 by Vinas. These backstops, while capable of interrupting the flight of a ball, are not suitable for carrying in a golf course environment.

Another common habit of many golfers is to carry an umbrella while out on the golf course for protection from the rain, sun and other weather elements. These umbrellas are typically attached to a fastener on the side of a golf cart so that they may be conveniently carried and so that they may be within easy access of the golfer when needed.

Other conventional apparatus which may have been disclosed for carrying an umbrella include the internal chamber of a golf club shaft as described in U.S. Pat. No. 1,686,323 by Von Der Heyde. Sometimes these umbrellas may include pockets for storing objects as disclosed in U.S. Pat. Nos. 4,336,817 by Shapiro; and 2,681,070 by D'Ippolito.

SUMMARY OF THE INVENTION

The present invention pertains to an umbrella which may be used in a first open position to protect the user against the sun and rain in a manner similar to a conventional umbrella, and which further may be used in another open position where the umbrella canopy is inverted frcm the first open position and is supported on its edge in an upstanding manner to act as a backstop to interrupt the flight of a low trajectory golf ball. The umbrella is adjustable between a closed position, the aforementioned first open position where the edges of the canopy extend downwardly toward the umbrella handle, a second open inverted position where the canopy is inverted from the first open position and it extends upwardly away from the umbrella handle, and a third open inverted position where the canopy is spread radially outward from the second open inverted position in a manner that its upper surface assumes a concave-like configuration. In this third open inverted position, the canopy is laid on its side, and pockets in the canopy are exposed in order to function both as targets and as ball receptacles.

It is therefore an object of the present invention to provide an umbrella which may be used in a first position for protection from the weather elements, and in a second position as a backstop and target for a golf ball.

BRIEF DESCRIPTION OF THE DRAWINGS

These and other objects and advantages of the present invention will become more readily apparent upon reading the following Detailed Description and upon reference to the attached drawings in which.

Figure 1:
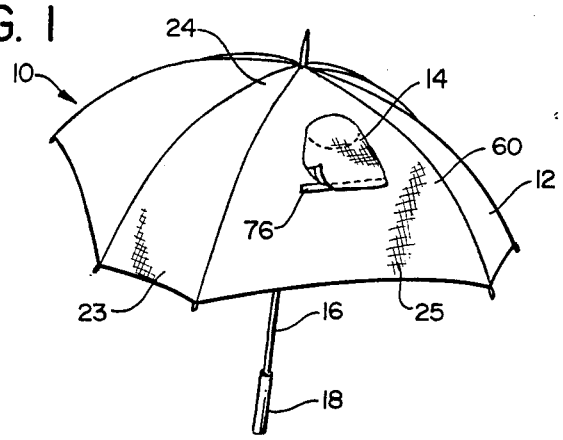
FIG. 1 is an isometric view of the apparatus of the present invention in the first open position for protection against the weather elements.

While the present invention is susceptible of various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents and alternatives falling within the spirit and scope of the invention as expressed in the appended claims.

DETAILED DESCRIPTION OF THE INVENTION

The present invention pertains to an umbrella indicated at 10, having a canopy 12 which may be opened manually to a first position shown in FIG. 1 where the umbrella may be used in a conventional manner for protection against the weather elements. The umbrella may be opened manually to another position, shown in FIG. 2, in which the canopy 12 is inverted from its position in FIG. 1, for use, when placed on its edge, as a backstop to interrupt the travel of a golf ball as shown in FIG. 3. The canopy includes pockets 14 which act as targets for the golfer as well as which collect the golf balls in the event the balls enter the pockets.

Figure 2:
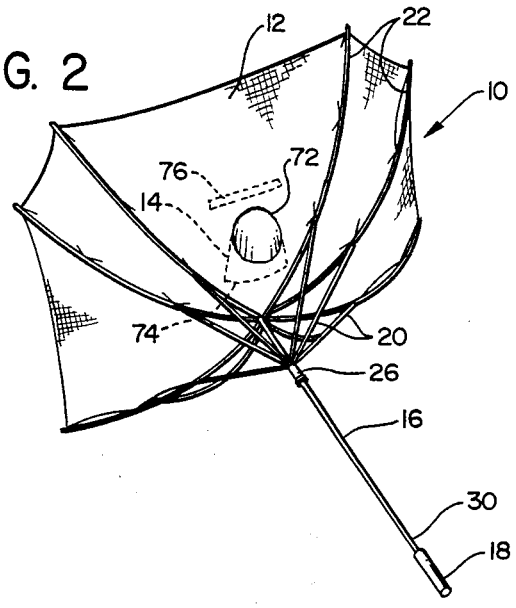
FIG. 2 is an isometric view of the apparatus in the third open inverted position where the canopy has been inverted and spread radially outward in a bowed configuration in order to act as a backstop.
Figure 3:
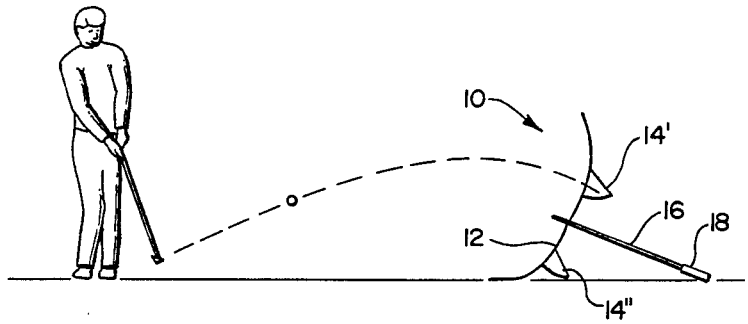
FIG. 3 is a pictorial representation of the use of the present invention as a backstop to interrupt the travel of a golf ball.
Figure 4:
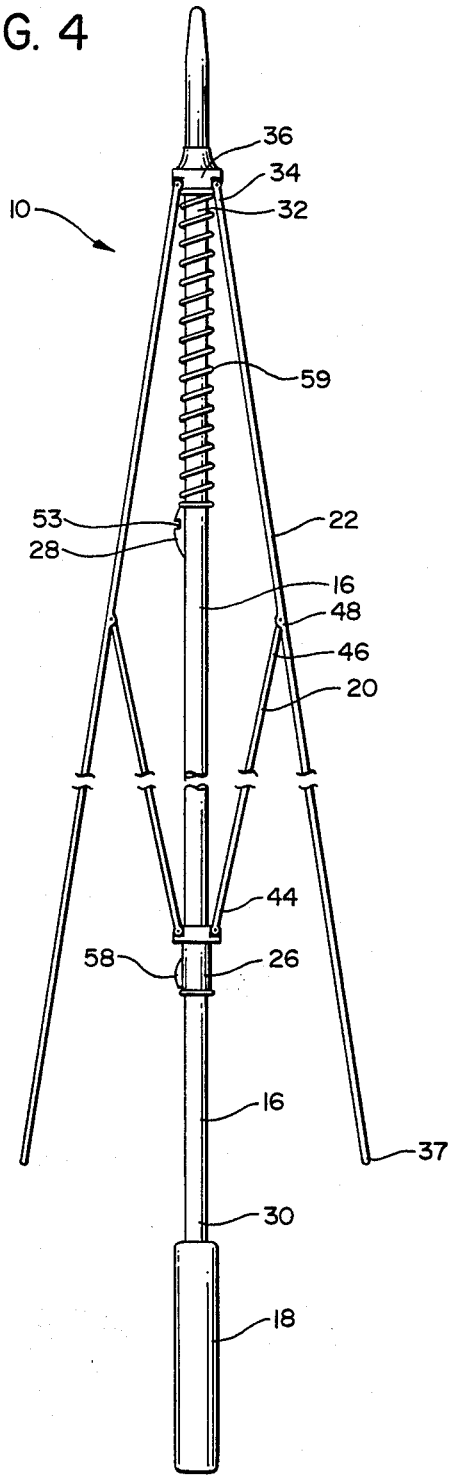
FIG. 4 is a side view of the apparatus, absent the canopy, in the closed position and showing internal supporting structure for supporting the canopy.

As shown in FIGS. 1 and 2, the principal elements of the umbrella 10, in addition to canopy 12, include an elongated shaft 16, a handle 18, canopy actuating struts 20, and canopy support ribs 22. The canopy 12, which has an upper surface 23 and which includes a middle portion 24 and an outer radial portion 25, is connected to the radially extending support ribs 22 outward of the actuating struts 20. Movement of the canopy between the closed and open positions is achieved by movement of an actuating sleeve 26 along shaft 16. The canopy actuating struts 20 are connected to the actuating sleeve 26 and to the canopy support ribs 22 in a manner that manual movement of sleeve 26 along shaft 16 in a direction away from handle 18, i.e. an upward direction, causes the support ribs 22 to spread radially outward from shaft 16 to a first open position shown in FIG. 1, where the struts 20 are loaded in compression to give the ribs 22 and the canopy 12 a curved configuration. At this position, actuating sleeve 26 is held at a fixed location on shaft 16 by a spring biased fastener 28 (FIG. 4). As sleeve 26 is moved manually further along shaft 16 past fastener 28 in the upward direction away from handle 18 and the canopy 12 is extended past its overcenter position shown in FIG. 6B, the canopy assumes a somewhat limp, inverted configuration, shown in FIGS. 7A and 7B where the struts 20 are subjected to little, if any, loading. However, by manually sliding actuating sleeve 26 along shaft 16 in a downward direction toward handle 18, to a location where it is again engaged by the fastener 28, the support ribs 22 and canopy 12 therewith are spread radially outward and form an inverted curved configuration as shown in FIGS. 8A and 8B, where the struts 20 are loaded in tension to provide the ribs 22 and the canopy 12 with their curved configuration. In this configuration the umbrella is laid on its side and used as a backstop in the manner shown in FIG. 3.

Figures 5A, 5B:
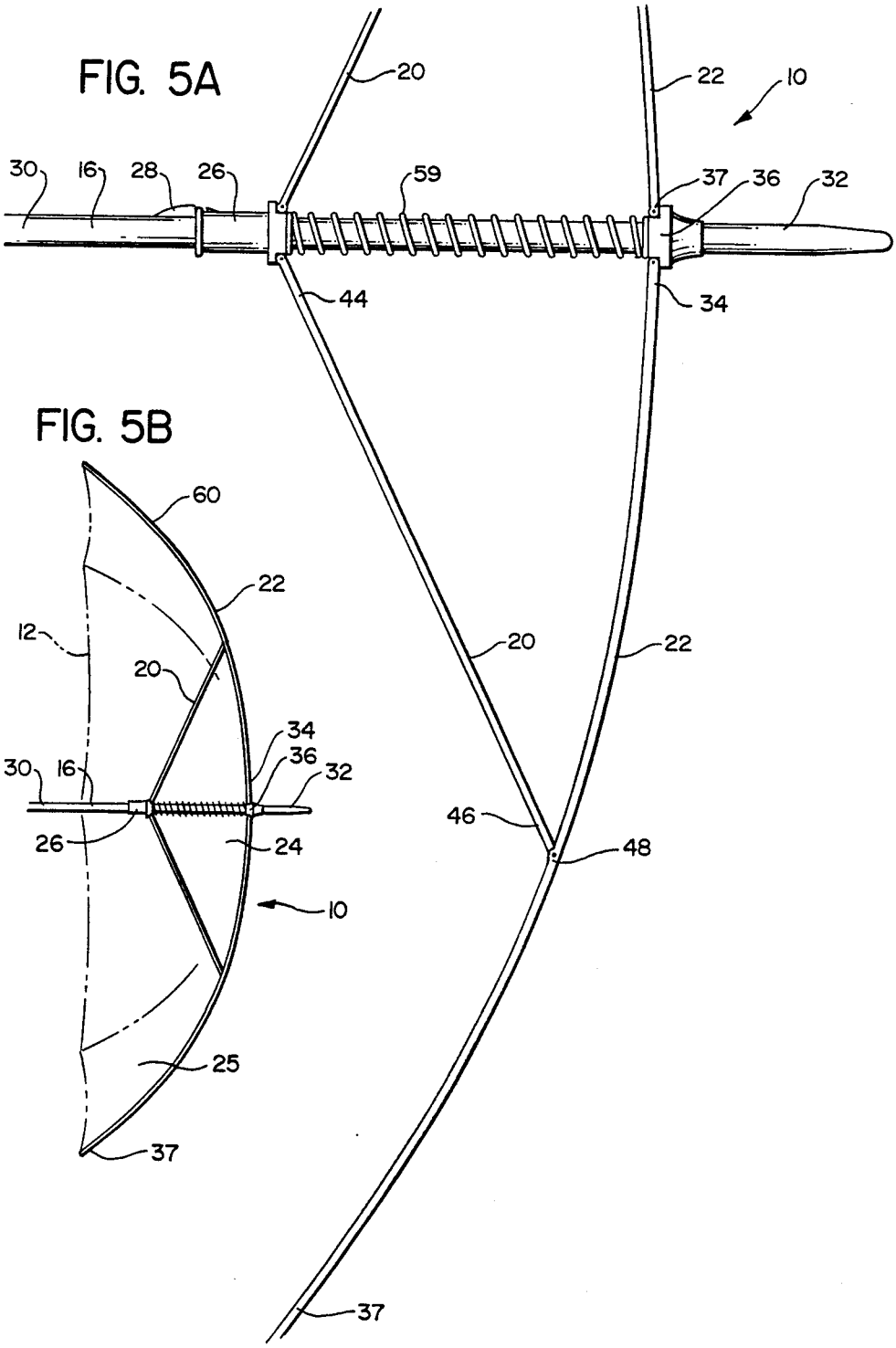
FIG. 5A is a side view of a portion of the apparatus absent the canopy.
FIG. 5B is a side view of the entire apparatus in the first open position, and showing the supporting structure in solid lines and the canopy in phantom.

Referring to FIG. 4, shaft 16 includes a handle end 30 and a canopy end 32. To permit movement of the canopy ribs 22 between the closed and open positions, the canopy ribs 22 are pivotally connected at their inner ends 34 to a cylindrical collar 36 which is rigidly fastened about the canopy end 32 of shaft 16 and which is also rigidly fastened to the middle portion 24 of the canopy 12. As with a conventional umbrella, in the closed position the canopy support ribs 22 are generally parallel with and adjacent to shaft 16 so that the outer ends 37 of the canopy support ribs 22 point toward handle 18. From this position, movement of the actuating sleeve 26 toward canopy end 32 causes outward radial and pivotal movement of the support ribs 22 from shaft 16. During this outward radial movement, the outer ends 37 of the adjacent canopy ribs 22 move outwardly from the shaft 16 and spread laterally from each other which in turn causes the canopy 12 to be spread and pulled taut as shown in FIG. 5B.

Unlike a conventional umbrella, the umbrella 10 of the present invention is deliberately designed and configured to permit a desired further axial movement of sleeve 26 along shaft 16 past fastener 28 and toward canopy end 32. This causes the canopy support ribs 22 to pull the canopy 12 past the overcenter position (shown in FIGS. 6A and 6B and designated by a line 35), to a location where the canopy 12 and canopy support ribs 22 assume a second open configuration shown in FIG. 7. In this position the canopy 12 is inverted, but generally slack, and the support ribs 22 are generally unbended. However, opposite axial movement of sleeve 26 in the downward direction toward handle end 30 to a location where the sleeve 26 is once again engaged by fastener 28, causes the canopy support ribs 22 and canopy 12 to assume a somewhat taut, bowed configuration as shown in FIG. 8, which herein is referred to as the third open inverted position, and which is adapted for use as a backstop.

Figure 9:
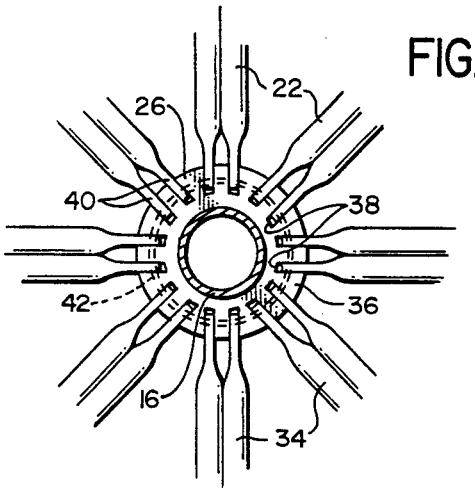
FIG. 9 is a view looking upward at a retaining collar for the ribs of the canopy supporting structure.

As further shown in FIG. 9, canopy ribs 22 are connected to collar 36 in a conventional manner. To accomplish this, collar 36 includes a plurality of rectangular recesses 38 located about its circumference. These recesses 38 are arranged in pairs in order to receive a pair of the flanged tips 40 of each canopy rib 22 therein. This causes the canopy ribs 22 to be connected in a radial manner about the circumference of collar 36. The flange tips 40 are secured within the recesses 38 by a retaining wire 42 which extends circumferentially about collar 36 within the recesses 38 and through openings in the flanged tips 40. This permits each canopy support rib 22 to pivot about the retaining wire 42 through an angle of about 135° from the closed position to the second open inverted position.

Referring again to FIG. 4, radial opening and closing of the canopy support ribs 22 is accomplished by the canopy actuating struts 20, each of which includes an inner end 44 which is pivotally connected to the actuating sleeve 26 and an outer end 46. Each outer end 46 is pivotally connected to a midportion 48 of the corresponding canopy support rib 22 to permit pivotal movement of the canopy actuating strut 20 between the closed position where the canopy actuating strut is generally parallel with and adjacent to shaft 16, through the first open position and the second open, inverted position, to the third open inverted position shown in FIGS. 8A and 8B where the actuating struts 20 extend outwardly and somewhat upwardly toward the canopy end 32 of shaft 16. In addition, the inner end 44 of each canopy actuating strut 20 includes a pair of flanged tips (not shown) which engage rectangular recesses which are located about the circumference of the upper part of actuating sleeve 26, in a manner similar to that described previously with regard to collar 36. A retaining wire (not shown) extends circumferentially about sleeve 26 and through holes in the flanged tips of the inner ends 44 to permit the aforementioned pivotal movement of the actuating struts 20 with respect to the sleeve 26. Thus, upward movement of sleeve 26 along shaft 16 causes the outer ends 46 of the actuating struts to move radially outward from shaft 16 which in turn causes outer radial movement of the canopy ribs 22 from the shaft 16. This is similar to the operation of a conventional umbrella.

Figures 6A, 6B:
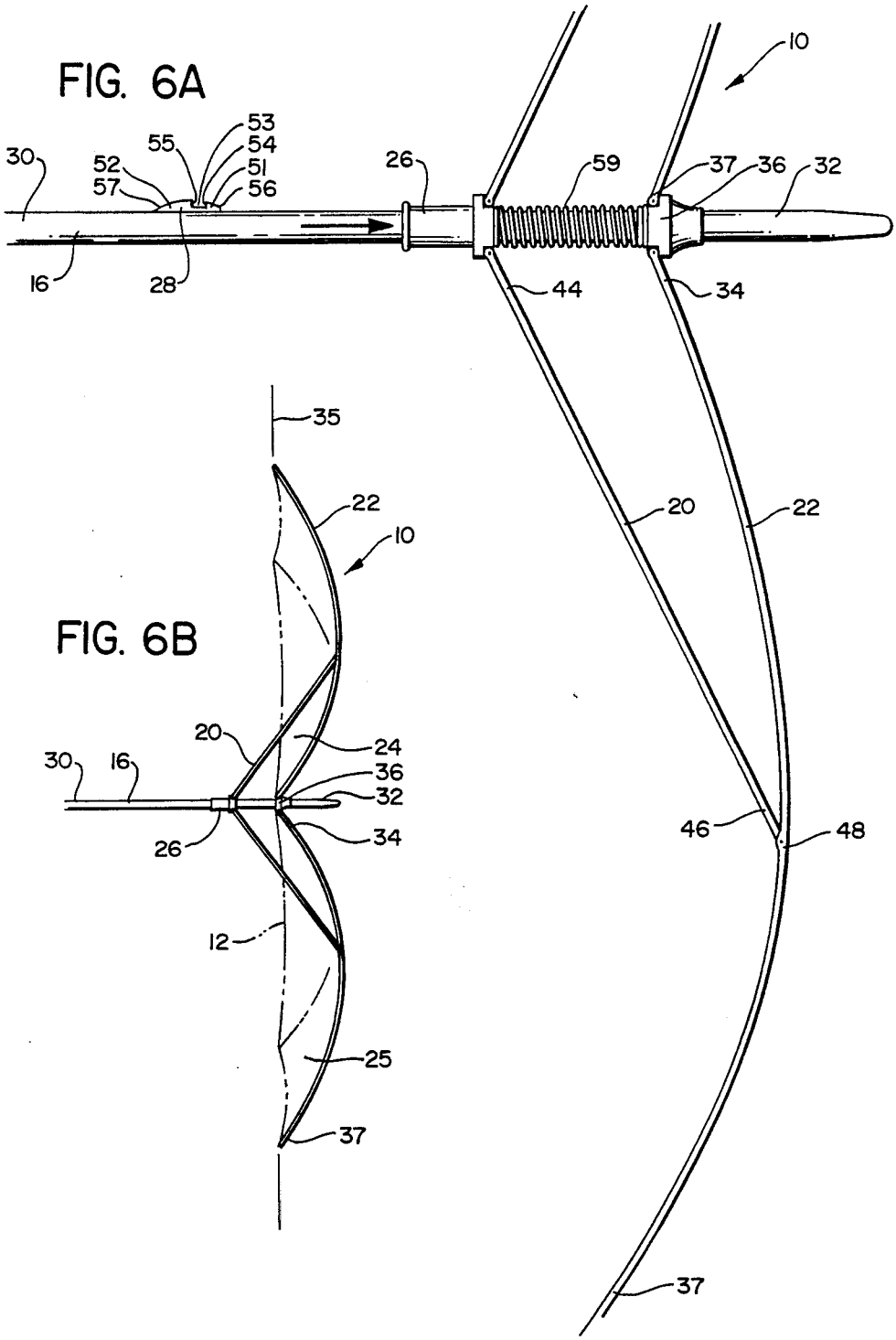
FIGS. 6A and 6B are side views similar to the views of FIGS. 5A and 5B showing the supporting structure and canopy prior to passing an overcenter position where the canopy becomes inverted.
Figure 10A:
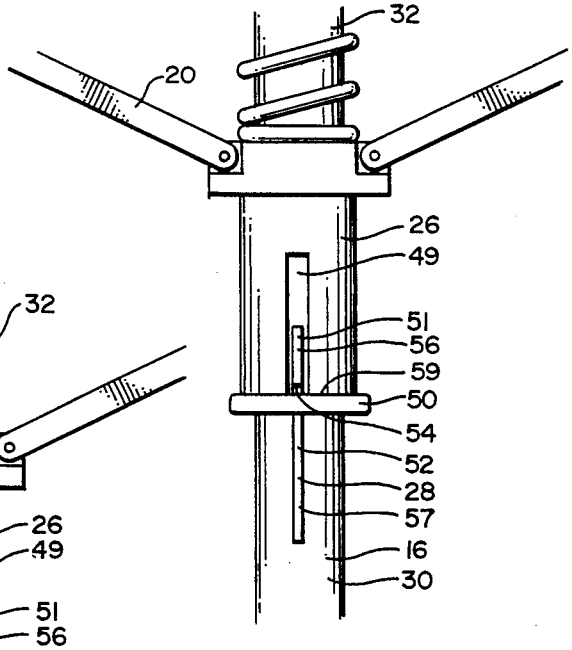
FIGS. 10A and 10B are side views of a portion of the apparatus showing fastening means for securing the apparatus in the first open and third open inverted positions.
Figure 10B:
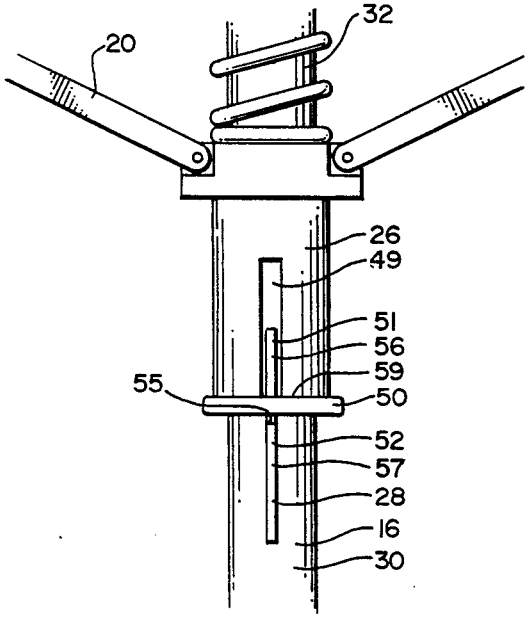

As discussed previously, there is a spring biased fastener 28 mounted at the canopy end 32 which engages a vertical slotted portion 49 (FIG. 10) of the actuating sleeve 26. The slot 49 terminates at a cylindrical lip 50 which extends circumferentially about the lower end of sleeve 26. As shown in FIG. 6A, the fastener 28 includes right, left portions 51, 52 which are separated by a rectangularly shaped recess 53 which is located in the outer edge of the fastener and which is formed by right, left end surfaces 54, 55 which are perpendicular to the longitudinal axis of shaft 16. It should be appreciated that the terms "right" and "left" correspond to the canopy end 32 and handle end 30, respectively. The fastener 28 also includes right, left tapered outer surfaces 56, 57 which join with the right, left end surfaces 54, 55, respectively, to form the right, left portions 51, 52. To permit actuating sleeve 26 to slide over the tapered surface 57 and engage recess 53 during movement to the first open position, surface 57 tapers outwardly from shaft 16 as it extends upwardly toward canopy end 32. This allows lip 50 to enter recess 53 and allows fastener right portion 51 to enter slot 49 as shown in FIG. 10A. In this position, the lower surface of lip 50 engages the left end surface 55 of the fastener 28 as a result of sleeve 26 being urged toward the handle end 30 by the bended canopy ribs 22. Depression of the fastener 28 permits further manual movement of the sleeve 26 toward the canopy end 32 and against the urging of the bended canopy ribs 22. However, when sleeve 26 is again engaged by the fastener 28 during movement of the sleeve 26 over the right tapered surface 56 and toward the handle end 30, as when the umbrella is being placed in the third open inverted position, lip 50 once again enters recess 53. Surface 56 is configured in a manner that it tapers outwardly from shaft 16 as it extends downward toward handle end 30. This causes the inward depression of fastener 20 as sleeve 26 slides over surface 56. In this manner the right fastener portion 51 enters sleeve slot 49, and the upper surface 59 of the sleeve lip 50 is engaged by the right end surface 54 of the fastener 28. This secures the umbrella in the third open position against the urging of the bended canopy ribs 22.

A second spring biased fastener 58, similar to fastener 28, is mounted on shaft 16 near the handle end portion 30 (FIG. 4). Fastener 58 engages the sleeve 26 to secure the supporting structure and the canopy 12 in the closed position. A helical spring 59 is mounted about the shaft 16 between the collar 36 and the upper fastener 28 in order to absorb the impact of the sleeve 26 when it is caused to move rapidly toward collar 36 when the canopy 12 passes through the overcenter position during inversion to the second open inverted position. The helical spring 59 also acts to bias the actuating sleeve 26 in the reverse direction toward handle 18 to aid in placing the umbrella in the third open inverted position.

Canopy support ribs 22 are made from a conventional aluminum material which has the inherent flexibility and strength to bend through various curved configurations. During the initial movement of actuating sleeve 26 (FIG. 4) toward canopy end 32 during opening, the upper ends 46 of the canopy actuating struts 20 which initially point in an upward direction toward canopy end 32, are caused to move radially outward, which in turn causes radial outward movement of the canopy support ribs 22. During this initial opening movement, there is very little bending of the canopy support ribs 22. However, as sleeve 26 moves upwardly along shaft 16 and engages fastener 28, this outward radial movement of the canopy support ribs 22 is resisted by the increasing tautness of the canopy 12. This is similar to that which occurs during the opening of a conventional umbrella. That is, as the canopy support ribs 22 are extended radially, the lateral distance between adjacent support ribs 22 increases thereby causing the fabric of the canopy 12 to become increasingly taut. When the canopy 12 achieves a taut configuration, any further opening and spreading of the canopy support ribs 22 is resisted. However, as actuating sleeve 26 is caused to move further upwardly along shaft 16 toward canopy end 32 (FIGS. 5A, 5B), the upward force exerted by the canopy actuating struts 20 through the midportions 48 of the canopy ribs 22 causes the canopy ribs 22 to bow resiliently outward relative to their inner and outer ends 34, 37, so as to form the conventional bowed configuration of an open umbrella, in which the upper surface 60 of the umbrella 10 has a convex configuration.

In the present invention, however, actuating sleeve 26 is adapted for further upward slidable movement toward canopy end 32 and beyond fastener 28. It should be appreciated that when the umbrella is in the first open position, the middle portions 48 of the canopy support ribs 22 are lower than are the inner ends 34 of ribs 22. However, movement of actuating sleeve 16 toward the canopy end 32 beyond fastener 28 causes displacement of the midportions 48 of the support ribs 22 away from handle end 30 so that the midportions 48 are located above the inner ends 34 of ribs 22 as shown in FIGS. 6A and 6B. This in turn causes movement of the outer radial portion 25 of the canopy 12 from a position shown in FIG. 5B where the outer radial portion 25 is lower than the central canopy portion 24, to a canopy overcenter location shown in FIG. 6. Further movement of the canopy outer portion 25 beyond the overcenter position, as a result of further upward movement of actuating sleeve 26 toward canopy end 32, causes the canopy 12 to invert and assume a somewhat V-shaped configuration shown in FIG. 7B where the outer radial portion 25 of the canopy is located above the middle portion 24 of the canopy. In this second open inverted position the outer ends 37 of the canopy support ribs 22 point in an upward direction away from handle 18. Furthermore, the canopy support ribs 22 form an unbended, relatively linear configuration in which the canopy ribs 22 are not sufficiently spread to pull the canopy 12 taut. This lack of rigidity of the canopy support ribs 22 and the slackness in the canopy 12 produces a somewhat flaccid structure which when supported on its side not only is unstable, but which does not have the properties which are desirable for a ball backstop.

With regard to the struts 20 and canopy 12 passing through the overcenter position, it should be recognized that this overcenter position is dependent not only on the particular location of the struts 20 and the canopy 12, but also on the physical characteristics of these components. With reference to FIGS. 6A and 6B, it can be seen that the struts 20 are bent from their straight configuration, so that the outer portions of the struts 20 are urged upwardly by the resiliency of the struts 20 attempting to return to the straight position. However, the upward movement of the outer portions of the struts 20 is resisted by the outer circumferential portions of the canopy 12 acting in tension so as to attempt to hold the outer portions of the struts 20 in a more radially inward position.

When the struts 20 are moved further upwardly, the outer portions of the ribs 22 become more horizontally aligned, and thus have a greater mechanical advantage, relative to the outer circumferential portion of the canopy 12. At a certain point, the upward force exerted by the outer portions of the ribs 22 overcomes the force exerted by the outer portions of the canopy 12, and the outer portions of the struts 20 spring upwardly to the position of FIGS. 7A and 7B. When the motion of the ribs 22 and canopy 12 is reversed by pulling the sleeve 26 downwardly, the reverse action occurs, but the same principles relative to the movement of the ribs 22 and the canopy 12 to the overcenter position still apply.

The positioning of the fastener 28 relative to the sleeve 26, the struts 20, the ribs 22 and the canopy 12 is such so that when the sleeve 26 is in the position of FIGS. 5A and 5B, the canopy 12 and the ribs 22 are well below the overcenter position. Also, when the canopy 12 and the ribs 22 are in the upwardly extending position, and when the sleeve 26 is moved downwardly to the location of the fastener 28, as illustrated in FIGS. 8A and 8B, the canopy 12 and the ribs 22 are above the second overcenter position through which the umbrella goes when returning to its conventional umbrella configuration.

Figure 7A:
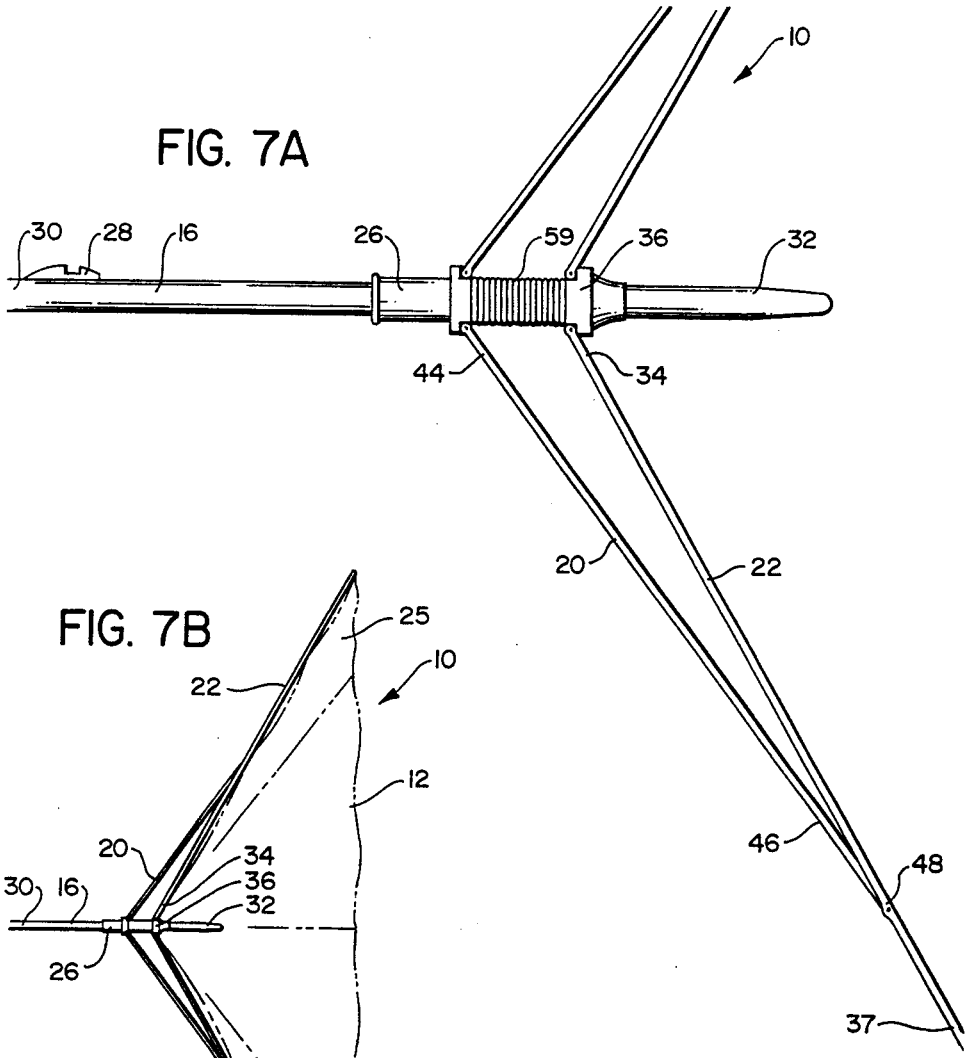
FIGS. 7A and 7B are side views similar to the views of FIGS. 5A and 5B, and showing the canopy and supporting structure in the second open position after inversion.
Figure 7B:
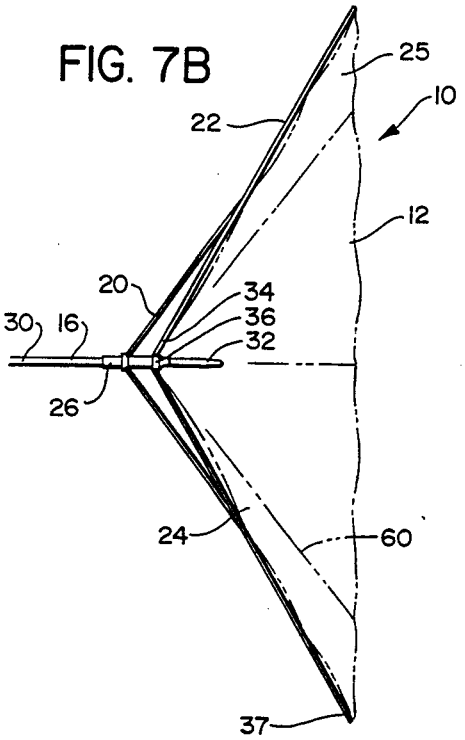
Figures 8A, 8B:
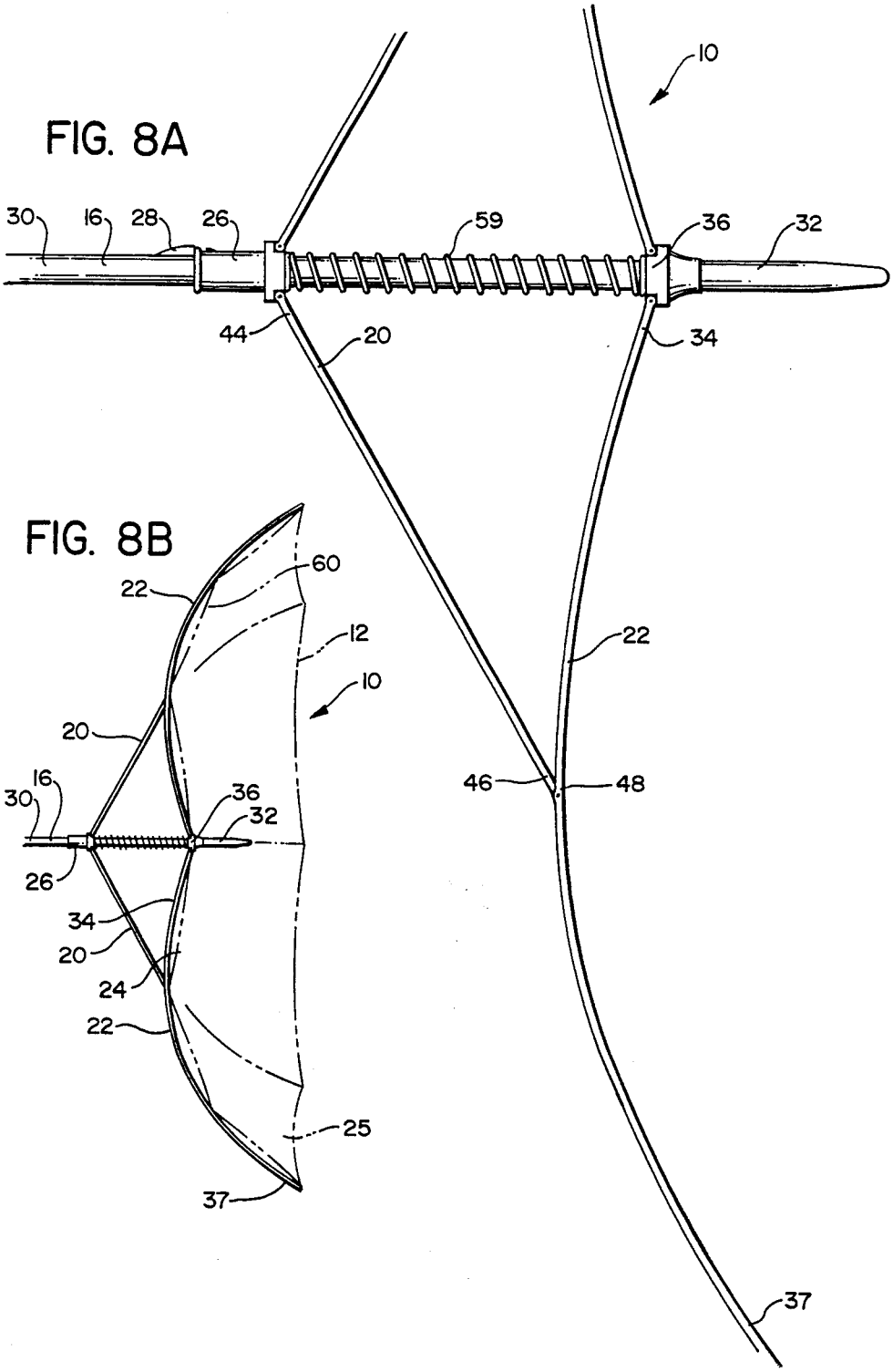
FIGS. 8A and 8B are side views similar to the views of FIGS. 5A and 5B, and showing the canopy and supporting structure in the third open inverted position where the supporting structure has assumed a bowed configuration and the canopy has become taut and is supported on its side for use as a backstop.

In the present invention, actuating sleeve 26 is slidable axially along shaft 16 in a reverse direction toward handle end 18 from its position shown in FIGS. 7A and 7B, where it is again engaged by fastener 28. This in turn causes the actuating struts 20 to exert a pulling force on midpoints 48 in the direction of handle end 30. This causes pivotal movement of the canopy support ribs 22 in an outward radial direction and causes increased lateral separation of the outer end portions 37, which in turn causes the canopy 12 to assume a taut configuration as shown in FIGS. 8A and 8B. As this tautness develops during movement of the actuating sleeve 26 toward handle end 30, any further opening radial expansion of the canopy 12 is resisted by the tension of canopy 12. However, further continued downward axial movement of the actuating sleeve 26 toward handle end 30, causes the midpoints 48 of the canopy support ribs 22 to be pulled downward, relative to their inner, outer end portions 34, 37, by the corresponding actuating struts 20. This achieves a bowing of the canopy support ribs in a manner that the upper surface 60 of the canopy forms a somewhat concave configuration as shown in FIG. 8B. In particular, the middle portion 24 of the canopy 12 has a substantial vertical alignment component, whereas the outer radial portion 25 has a generally curved configuration. In this position, the canopy support ribs 22 have a curved configuration which is structurally rigid so that when the umbrella is laid on its side and supported by the handles 18 and the outer ends 37 of two of the canopy support ribs 22, the umbrella is supported in a stabilized manner to resist unwanted rotation about the longitudinal axis of shaft 16. The concave configuration of the outer surface 60 is suitable for reversing the direction of a golf ball which lands on the canopy 12 in a manner to return the ball in a direction towards the golfer. In addition, the tautness of the canopy 12 causes a golf ball to resiliently strike the canopy in a manner that the golf ball rebounds from the canopy to return towards the golfer.

In a preferred embodiment of the present invention as shown in FIGS. 1 through 3, umbrella 10 includes upper, lower pockets 14', 14'' which are attached to the middle portion 24 of the canopy 12. Each pocket 14 includes a circular base portion 72 which is attached to a circular opening in the canopy 12. The bottom of the pocket 14 is formed by a laterally extending edge 74 which may be releasably secured to the outer surface 60 of the canopy by a hook and loop fastener 76. When the umbrella is being used in a conventional manner in the first open position, the pocket is engaged to the canopy 12 by the fastener 76 in a manner that the pocket 14 is flush with the outer surface 60 of the canopy. However, when the umbrella 10 is in the third open position for use as a backstop, the bottom of the pocket 14 is detached frcm the canopy 12, and the position of the pocket is reversed so that the bottom of the pocket extends toward the handle 18, and the opening 72 of the canopy 12 forms a target for the golfer. It should be appreciated that the support ribs 22 are grouped in pairs about canopy 12 as shown in FIG. 2. This allows for an increased lateral separation between these paired groups to permit the incorporation of pockets 14.

When the golfer is finished using the umbrella as a backstop, the pockets 14 are reattached to the outer surface of the canopy 12. The fastener 28 is disengaged and the actuating sleeve 26 is moved downward along the shaft 16 toward the handle end 30. This exerts a greater pulling force via the actuating struts 20 at the midportion 48 of each canopy support rib 22 so that the canopy support ribs 22 assume an increasingly bowed configuration. This in turn causes movement of the canopy outer radial portion 25 downward toward the handle end 30 until the outer radial portion 25 passes the overcenter position 35, where the canopy 12 assumes the configuration showing FIG. 4 where the end portions 37 of the canopy ribs 22 point toward the handle 18. Further movement of the actuating sleeve 26 toward the handle 18 causes the canopy to assume the closed position.

What is claimed is:

1. An apparatus having a first operational mode for use as an umbrella and a second operational mode for use as a backstop to interrupt the travel of a ball, said apparatus comprising:

a. canopy means including (i) a canopy cover having a middle portion, an outer radial portion, and an upper surface, and (ii) a plurality of flexible canopy support ribs, each of which has an inner end portion and an outer end portion, said canopy cover being connected to said canopy ribs in a manner that the inner end portions of the ribs support the middle portion of said canopy cover and the outer end portions of theribs support the outer radial portion of said canopy cover;

b. a support shaft including (i) a lower handle end, and (ii) an upper canopy end to which the inner end portions of said canopy support ribs are pivotally connected; and c. actuating means for moving said canopy means between (i) a closed position where said canopy ribs have a substantially unbended configuration and said canopy ribs extend in a first downward direction toward said handle end, (ii) an open position in which said canopy ribs have a bended configuration and the outer radial portion of said canopy cover extends downwardly from said middle portion, (iii) a first open inverted position where said canopy ribs extend upwardly in a substantially unbended manner toward said canopy end and the outer radial portion of said canopy cover extends upwardly from said middle portion of said canopy cover, and (iv) a second open inverted position where said canopy ribs have a bended configuration and said outer radial portion of said canopy cover extends upwardly from said middle portion of said canopy cover so that said upper surface of said canopy cover has a concave-like configuration, said canopy actuating means including extension and retraction means which are operatively engaged to said canopy ribs at respective first connecting locations between said inner end portions and said outer end portions of said canopy ribs for operation in a manner so that upward movement of said extension and retraction menas toward said canopy end causes pivotal movement of said canopy ribs in a radial direction outwardly from said shaft to a location where the apparatus is secured in said first open position and in said first operational mode, and that further upward movement of said canopy extension and retraction means causes said canopy cover to cross an overcentrer location and to occupy said first open inverted position, and then opposite downward movement of said extension and retraction means from open inverted position toward said handle end without crossing the overcenter location displaces said first locations of said canopy ribs downward toward said handle end to place said canopy means in said second open inverted configuration for use in said second operational mode; and d. fastening means which are connected to said shaft and which engage said extension and retraction means when said canopy means is in (i) the first open position, and (ii) the second open inverted position, to prevent movement of said extension and retraction means in the upward or downward direction and to secure said apparatus in the first and second operational modes, respectively.

2. The apparatus as set forth in claim 1 wherein said extension and retraction means includes:

a. a base member which is attached to said shaft for axial movement along said shaft between said handle end and said canopy end; and b. a plurality of extension members each having a first end which is connected to aid base member at a second connecting location and a second end which is pivotally connected to said canopy rib at said first connecting location in a manner that (i) upward movement of said base member toward said canopy end causes said extension member to pivot about said second connecting locations outwardly from said shaft to cause said outward radial movement of said canopy ribs to said open position, (ii) further movement of said base toward said canopy end causes said extension members to displace said first connecting locations of said canopy ribs toward said canopy end in a manner to cause said canopy means to form said first open inverted configuration, and then (iii) opposite downward movement of said base member from said first open inverted position toward said handle end causes said extension members to displace said first connecting locations toward said handle end to cause said canopy ribs to form said bended configuration in said second open inverted position.

3. The apparatus as set forth in claim 2 wherein:

a. said outer end portions of said canopy ribs are spaced apart in a manner that said outer end portions of adjacent canopy ribs are separated by a first distance when said apparatus is in said first open inverted position, said first distance being less than the length of the canopy cover between said adjacent outer end portions so that said canopy cover has a slack configuration in said first open inverted configuration; and b. said adjacent outer end portions of said canopy ribs are spaced apart a second distance in said second open inverted configuration which is greater than said first distance and which is substantially equal to the length of said canopy cover between said adjacent outer end portions to causes said canopy cover to have a taut configuration in said second open inverted configuration.

4. The apparatus as set forth in claim 3 wherein said base member has a sleeve portion which engages said shaft for axial slidable movement thereon.

5. The apparatus as set forth in claim 4 wherein:

a. said fastening means includes a fastener member which is connected to said shaft; and b. said fastener member has an outer surface which includes a recessed portion which is formed by first and second end surfaces each of which has a substantial alignment component which is perpendicular to the longitudinal axis of said shaft in a manner that said first end surface engages said sleeve portion when said sleeve portion is in the open position to prevent movement of said sleeve portion toward said handle end in order to secure the apparatus in the open position, and said second end surface engages said sleeve portion when said sleeve portion is in the second open inverted position to prevent movement of said sleeve portion toward said canopy end in order to secure the apparatus in the second open inverted position.

6. The apparatus as set forth in claim 5 wherein said fastener member of said fastening means includes a first tapered portion which extends inwardly toward said shaft as said first tapered portion extends toward said canopy end so as to permit slidable movement of said sleeve portion across said first tapered portion during downward movement from the first open inverted position to the second open inverted position so that said sleeve portion engages said first tapered portion during said downward movement to cause fastener member to move inwardly toward said shaft and permit said sleeve portion to be engaged within said recessed portion.

7. The apparatus as set forth in claim 5 wherein said shaft includes a canopy end portion which is located between said fastener member and the upper canopy end to permit axial slidable movement of said sleeve portion (i) upwardly toward said canopy end beyond said fastener member to cause said extension members to displace said first connecting locations of said canopy ribs toward said canopy end and to invert said canopy menas to said first open inverted position, and (ii) from said first open invered position downwardly toward said handle end to be engaged by said fastener member and to cause said extension members to displace said first connecting locations of said canopy ribs toward said handle end so that said upper surface of said canopy means forms a taut concave-like configuration in said second open inverted position.

8. The apparatus as set forth in claim 2 wherein:

a. said canopy cover includes an opening therein which is used as a target when said apparatus is used in said second operational mode; and b. said canopy cover includes a pocket attached about the circumference of said opening.

9. The apparatus as set forth in claim 8 wherein said pocket includes a lower edge portion which is adapted to be fastened to the outer surface of said canopy cover when said apparatus is used in said first operational mode in a manner to close said pocket opening at the outer surface of said canopy cover.

10. An umbrella-like apparatus for use as a backstop to interrupt the travel of a ball, said apparatus comprising a. canopy means including (i) a canopy cover having a middle portion, an outer radial portion, and an upper surface, and (ii) a plurality of flexible canopy support ribs, each of which has an inner end portion and an outer end portion, said canopy cover being connected to said canopy ribs in a manner that said inner end portions of said canopy ribs support said middle portion of said canopy cover, and said outer end portions of said canopy ribs support said outer radial portion of said canopy cover;

b. a support shaft including (i) a handle end, and (ii) a canopy end to which said inner ends of said canopy support ribs are connected; and c. canopy actuating means for moving said canopy means between (i) a first closed position where said canopy ribs extend said first downward direction toward said handle end, and said middle portion of said canopy cover is above said outer radial portion of said canopy cover, (ii) a second open inverted position where said canopy ribs extend upwardly in a substantially unbended manner toward said canopy end and said outer radial portion of said canopy cover is located above said middle portion of said canopy cover, and (iii) a third open inverted position where said canopy ribs have a bended configuration and said outer radial portion of said canopy cover is located above said middle portion of said canopy cover so that said upper surface of said canopy cover has a bowed configuration, said canopy actuating means including extension and retraction means which is operatively engaged to said canopy ribs at respective first connecting locations between said inner end portions and said outer end portions of said canopy ribs in a manner that upward movement of said extension and retraction means toward said canopy end causes pivotal movement of said canopy ribs about said first pivot location and in a radial direction outwardly from said shaft, and displacement of said first connecting locations of said canopy ribs upwardly toward said canopy end causes said canopy cover to cross an overcenter location and to assume said first open inverted configuration, and downward movement of said extension and retraction means from said first open inverted configuration toward said handle end displaces said first connecting locations of said canopy ribs toward said handle end to cause said canopy ribs to form said bended configuration and to place said canopy means in said third open inverted configuration for use in an operational mode in which said apparatus is supported on a surface by said handle end portion and said canopy means in a manner that said canopy cover has a substantial alignment component which is in the vertical direction; and d. fastening means which are connected to said shaft and which engage said extension and retraction means when said canopy menas is in the second open inverted position to prevent movement of said extension and retraction means in the upward or downward directions and to secure said apparatus in the operational modes.

11. A method of providing a backstop to interrupt the travel of a ball, by using an umbrella having (i) a canopy cover including a middle portion, an outer radial portion and an upper surface, (ii) a plurality of flexible canopy support ribs each of which has an inner end portion and an outer end portion, the canopy cover being connected to the canopy ribs in a manner that the inner end portions of the canopy ribs support the middle portion of the canopy cover and the outer end portions of the canopy ribs support the outer radial portion of the canopy cover, and (iii) a support shaft including a handle end, and canopy end to which the inner end portions of the canopy support ribs are connected at respective first pivot locations, the method comprising the steps of:

a. first moving the canopy support ribs from a closed position, where the canopy ribs have a substantial alignment component which is parallel to the shaft and the canopy ribs extend in the first downward direction toward the handle end, upwardly and outwardly to a first open position;

b. securing the canopy ribs in the first open position to use the canopy cover as protection against weather elements and where the canopy ribs have a bended configuration and the outer radial portion of the canopy cover extends downwardly from the middle portion;

c. then moving the canopy ribs from the first open position upwardly and past a canopy overcenter location to a first open inverted position where (i) the canopy ribs extend upwardly in an unbended manner toward the canopy end, (ii) the outer radial portion of the canopy cover extends upwardly from the middle portion, and (iii) the canopy cover has a slack configuration;

d. further moving the canopy ribs downwardly from the first open inverted position, without passing the overcenter location, to a second open inverted position where the canopy ribs have a bended configuration, and the outer radial portion extends upwardly from the middle portion so that the upper surface of the canopy cover has a taut, concave-like configuration;

e. securing the canopy ribs in the second open inverted position; and f. supporting the handle end portion and the canopy cover on a surface ina manner that the canopy cover has a substantial alignment component which is in the vertical direction for use as the backstop.

* * * * *